US011291900B2

(12) United States Patent
Allred

(10) Patent No.: US 11,291,900 B2
(45) Date of Patent: Apr. 5, 2022

(54) AUDIBLE EXERCISE SYSTEM FOR STRIKING AND METHOD OF USE

(71) Applicant: Alexandra Allred, Waxahachie, TX (US)

(72) Inventor: Alexandra Allred, Waxahachie, TX (US)

( * ) Notice: Subject to any disclaimer, the term of this patent is extended or adjusted under 35 U.S.C. 154(b) by 231 days.

(21) Appl. No.: 16/126,159

(22) Filed: Sep. 10, 2018

(65) Prior Publication Data

US 2021/0308547 A1 Oct. 7, 2021

Related U.S. Application Data

(63) Continuation-in-part of application No. 15/205,573, filed on Jul. 8, 2016, now abandoned.

(51) Int. Cl.

| | |
|---|---|
| ***A63B 69/32*** | (2006.01) |
| ***A63B 71/06*** | (2006.01) |
| ***A63B 69/00*** | (2006.01) |
| ***A63B 21/00*** | (2006.01) |

(52) U.S. Cl.

CPC ..... *A63B 69/32* (2013.01); *A63B 69/004* (2013.01); *A63B 71/0622* (2013.01); *A63B 21/00047* (2013.01); *A63B 2071/0625* (2013.01)

(58) Field of Classification Search

CPC ..... A63B 69/32; A63B 69/004; A63B 69/20; A63B 69/201; A63B 69/203; A63B 69/205; A63B 69/206; A63B 69/208; A63B 69/24; A63B 69/325; A63B 71/0622; A63B 2071/0625; A63B 21/00047; A63B 21/1618; A63B 21/1627; A63B 21/1636; A63B 21/1645; A63B 21/1654; A63B 21/1663; A63B 21/1681; A63B 21/169; A63B 22/0002; A63B 22/04; A63B 22/12; A63B 22/1209; A63B 23/035; A63B 23/03516

See application file for complete search history.

(56) References Cited

U.S. PATENT DOCUMENTS

| | | | | |
|---|---|---|---|---|
| 8,002,676 | B1 * | 8/2011 | Corona | A63B 69/0002 482/83 |
| 8,079,938 | B2 * | 12/2011 | Jones | G09B 19/0038 482/8 |
| 10,145,656 | B2 * | 12/2018 | Gaynor | F41H 5/08 |
| 10,668,349 | B2 * | 6/2020 | Yachin | A63B 69/004 |
| 2014/0128227 | A1 * | 5/2014 | Ladas | A63B 69/20 482/84 |
| 2015/0375079 | A1 * | 12/2015 | Wood | A63B 71/06 482/8 |
| 2017/0087435 | A1 * | 3/2017 | Jones | A63B 24/0062 |
| 2018/0093160 | A1 * | 4/2018 | Alhadeff | A63B 24/0062 |
| 2019/0388760 | A1 * | 12/2019 | Morin | A63B 71/0622 |

* cited by examiner

*Primary Examiner* — Megan Anderson

(74) *Attorney, Agent, or Firm* — Leavitt Eldredge Law Firm

(57) ABSTRACT

An exercise system includes a target having a rectangular body composed of a polycarbonate material; a first handle having an opening extending through a thickness of the rectangular body; striking the rectangular body causes an audible noise.

5 Claims, 6 Drawing Sheets

AUDIBLE EXERCISE SYSTEM FOR STRIKING AND METHOD OF USE

BACKGROUND

1. Field of the Invention

The present invention relates generally to exercise systems, and more specifically, to an audible exercising system for striking, punching, or kicking.

2. Description of Related Art

Exercise systems for striking are well known in the art and are effective means to improve many aspects of physical fitness including self-defense, strength, and muscle control. For example, FIG. 1 depicts a conventional exercise system for punching and kicking 101 having leg units 102 attached to an upright base unit 103, which in turn is attached to a striking apparatus 104. During use, the user punches, kicks, or otherwise strikes the apparatus 104. Accordingly, the striking apparatus 104 provides the user with a target and resistance.

One of the problems commonly associated with system 101 is its limited appeal. For example, because of the bulky size of system 101 as well as any stereotype of system 101 being associated with boxers and fighters, many women and young users may feel intimidated and/or uninterested in using system 101.

Additionally, system 101 may be further limited in its appeal by being too large to easily transport. Further, the system 101 is very expensive, thereby becoming cost prohibitive to many users.

Accordingly, although great strides have been made in the area of exercise systems for striking, punching, and kicking, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
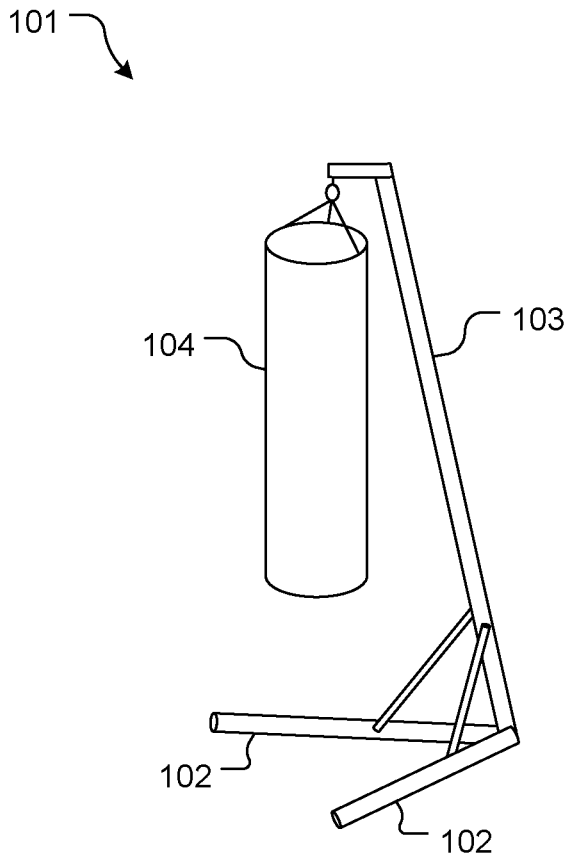
FIG. 1 (Prior Art)
FIG. 1 is a side view of a conventional striking exercise system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise systems for striking. Specifically, the contemplated application integrates a lightweight striking apparatus, making the system more appealing to all potential users. In addition, the contemplated application provides motivational feedback to encourage and instruct all users. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
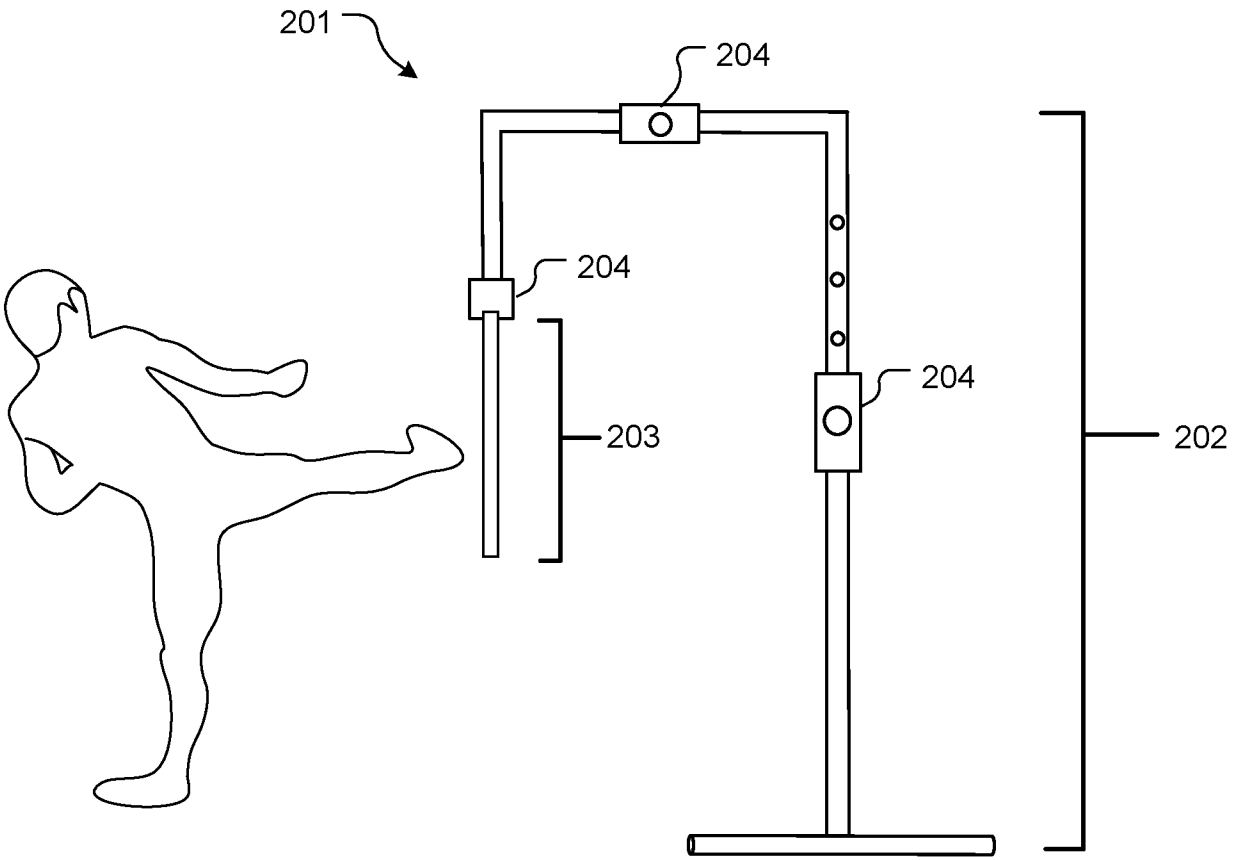
FIG. 2 is a side view of a striking exercise system in accordance with a preferred embodiment of the present application.

Referring now to the drawings wherein like reference characters identify corresponding or similar elements throughout the several views, FIG. 2 depicts a side view of an audible exercise system designed for punching, kicking, or striking in accordance with a preferred embodiment of the present application. It will be appreciated that system 201 overcomes one or more of the above-listed problems commonly associated with conventional exercise systems designed for striking.

In the contemplated embodiment, system 201 includes a support system 202 in communication with a striking target 203. The support system 202 may have one or more pivot joints 204 capable of adjustment. During use, the support system 202 holds the striking target 203 in any manner allowing the user to kick, punch, or strike the target 203.

It should be appreciated that one of the unique features believed characteristic of the present application is that the striking target 203 can consist of a material that is lightweight and capable of reacting with a sound upon impact. One such material contemplated is a multi-layered sheet composed of a flexible base layer surrounded on both sides with more ridged layers. It is understood that when such a material is struck by the user it will react with a snapping or popping sound thereby increasing the appeal of system 201 by providing motivation and feedback. Additionally, it is contemplated that the striking target 203 is not limited to such sheet-like materials but can also include any interactive system that provides motivational feedback when struck. Further, the lightweight feature of target 203 allows the system to be inexpensive and portable.

Figure 3C:
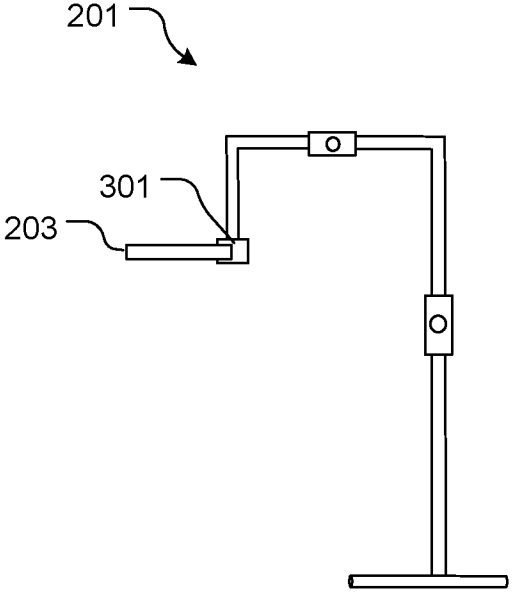
FIGS. 3A, 3B, and 3C are side views of a striking exercise system in accordance with a preferred embodiment of the present application in three orientations.
Figure 3B:
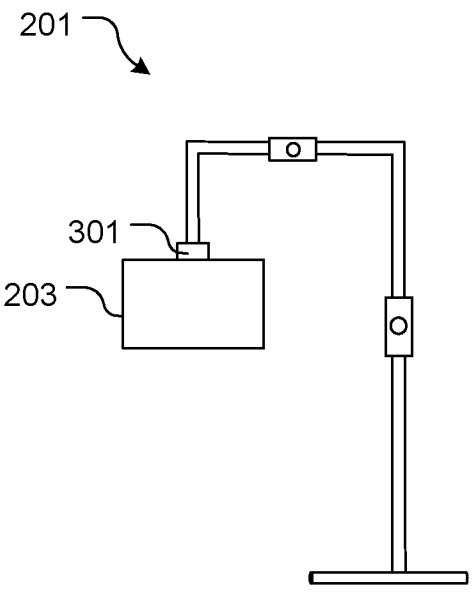
Figure 3A:
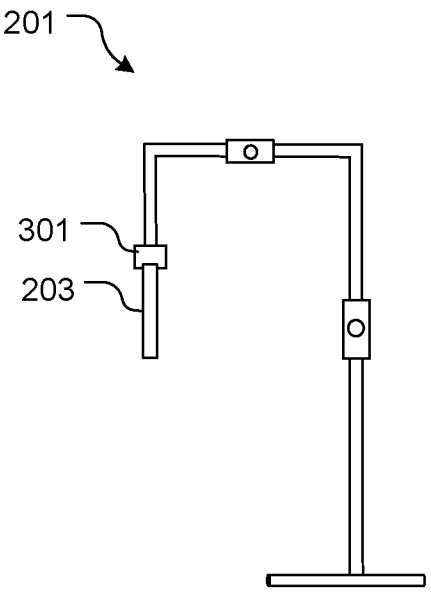

It will be appreciated that system 201 is capable of multiple variations. Referring now to FIGS. 3A, 3B, and 3C side views of system 201 are shown in accordance with a preferred embodiment of the present application. As the user desires different exercise movements, the striking target 203 can be adjusted to various orientations.

Although striking target 203 is shown primarily flat, alternative embodiments contemplate that the target 203 can vary in shape as functional, manufacturing, or aesthetic considerations require. It is contemplated that a user can change the intensity of their workout by changing the striking target 203. For example, a heavier target 203 will provide the user with more resistance during their workout. As shown in FIG. 3A, a locking device 301 is utilized to secure the striking target 203 in a vertical-front position; FIG. 3B shows the locking device 301 configured to secure the target 203 in a vertical-side position; and FIG. 3C show the locking device 301 configured to secure the target 203 in a horizontal position. In each embodiment, the target is capable of swinging relative to the locking device as a predetermined force is applied thereagainst.

Figure 4:
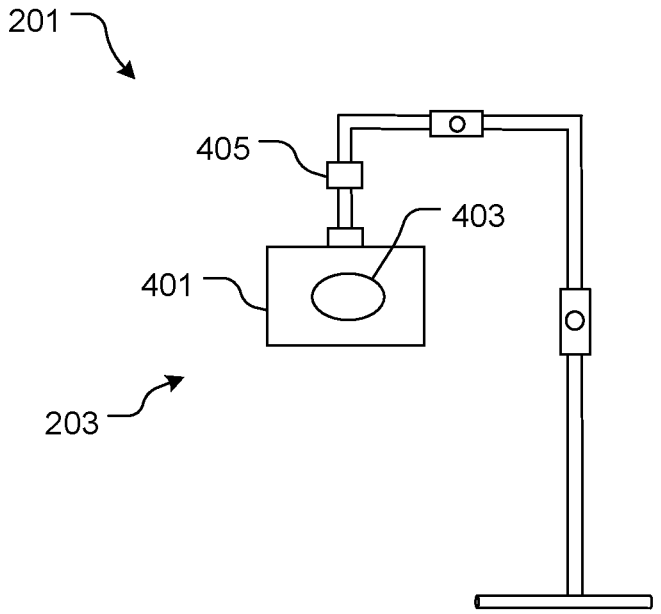
FIG. 4 is a front view of a striking system in accordance to an alternative embodiment.

Referring now to FIG. 4 in the drawings, system 201 is further contemplated having a target 203 with two sections 401, 403 configured to provide an alert via control system 405. For example, hitting target section 403 will create a different notification than if a force is applied against section 401.

Figure 5:
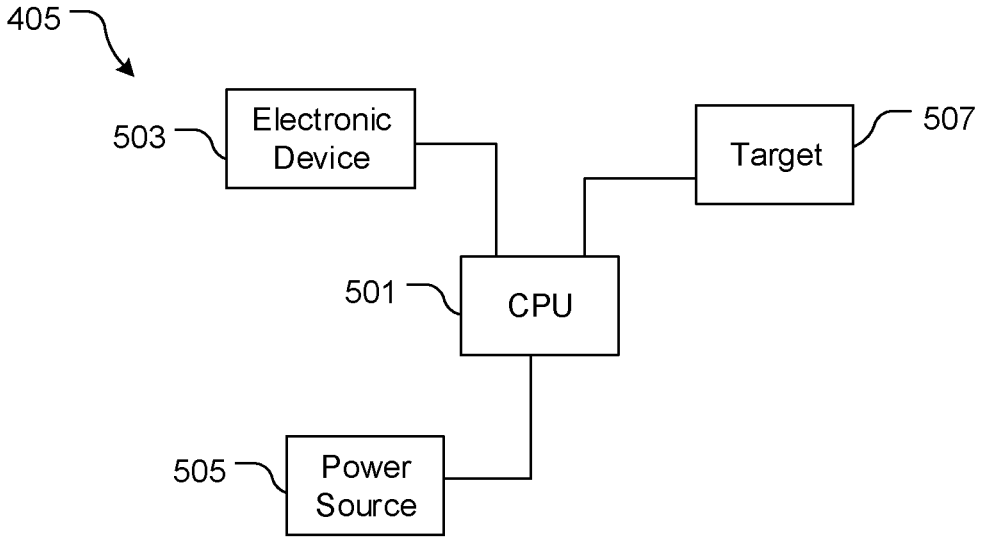
FIG. 5 is a simplified schematic of a control system of the system of FIG. 4.

In FIG. 5, a simplified schematic of the control system 405 is shown having a central computer 501 operably associated with an electronic notification device 503, the target 507, and a power source 505. It should be understood that target 507 is preferably target 203.

The electronic notification device 503 could be an audible alarm or a visual display. For example, as section 403 is hit, the device 503 could sound a siren and/or illuminate a light.

Figure 6:
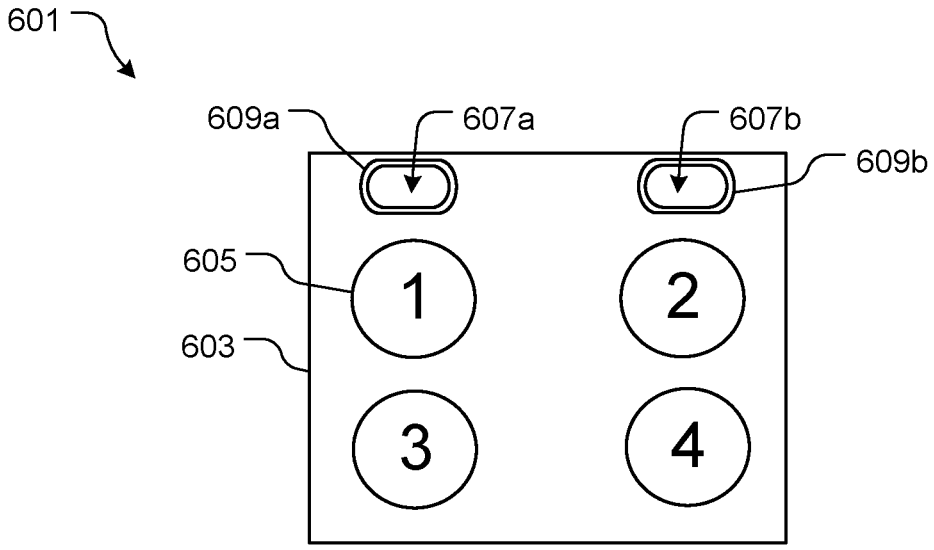
FIG. 6 is a front view of a target in accordance with an alternative embodiment of the present application.

In FIG. 6, an alternative embodiment of a target 601 is shown, having a target body 603, preferably composed of a flexible material, such as a polycarbonate, thereby allowing for the target to flex upon being struck. In addition, in this embodiment, the target 601 includes image depictions 605 on the front, thereby providing for visual targets for the user to strike at. In one embodiment, the image depictions are numbers, as shown, this embodiment can be used for individuals with special needs to encourage striking at a specific point, thereby being fun, interactive and mentally stimulating. In other embodiments, the visual depictions can depict phrases, such as "boom", "strike", and the like. These depictions further encourage a multi-directional, cross-pattern action for the user, thereby aiding in fostering spatial and cognitive skills sets.

As further shown in FIG. 6, target 601 can include handles comprising openings 607*a-b* wherein a second user can insert their hands to hold the target in place for the first user to strike at. In some embodiments, the openings 607*a-b* are surrounded by a rubber/plastic 609*a-b* to create a gripping structure. In this embodiment, the target can vary in size, but one preferred size is an 18×22 inch rectangle.

It must further be understood that in this embodiment, the target does not include any padding, as it is desirable to have a no-impact striking surface for therapeutic activities.

Figure 7:
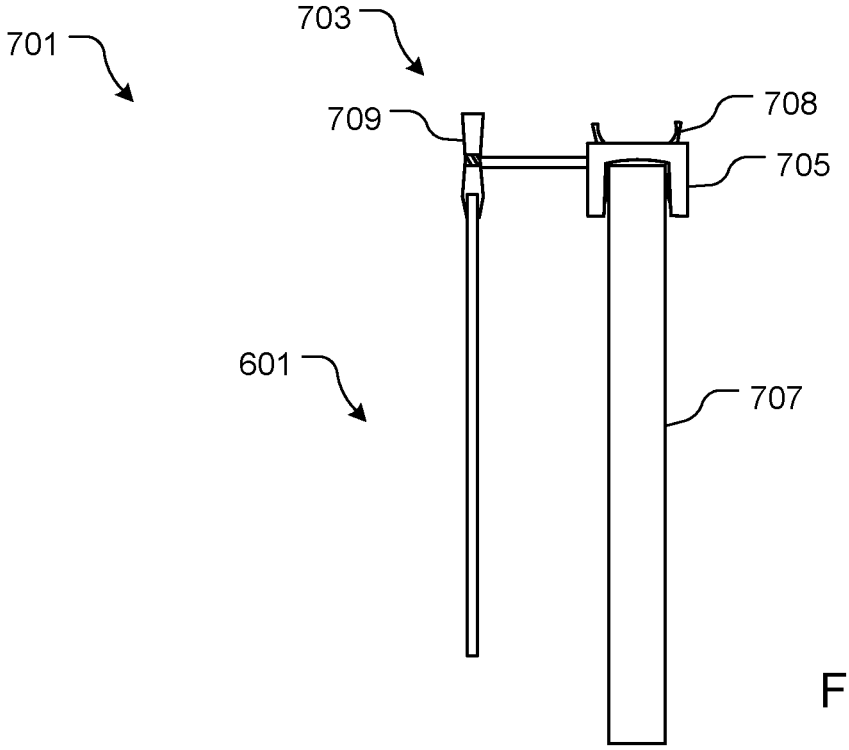
FIG. 7 is a side view of an exercise system in accordance with the alternative embodiment of the present application.

In FIG. 7, an alternative embodiment of an audible exercise system 701 is shown, wherein target 601 is engaged with one or more holders 703, wherein the one or more holders each have a clamping device 705 configured to secure to a structure 707, such as a door 707. The clamping device 705 can have one or more releases 708 to release and engage the clamp with the structure. In addition, each holder 703 can have a clip 709, such as a spring loaded clip configured to engage with the openings 607. This system allows for the user to use target 601 in a variety of locations.

Figure 8:
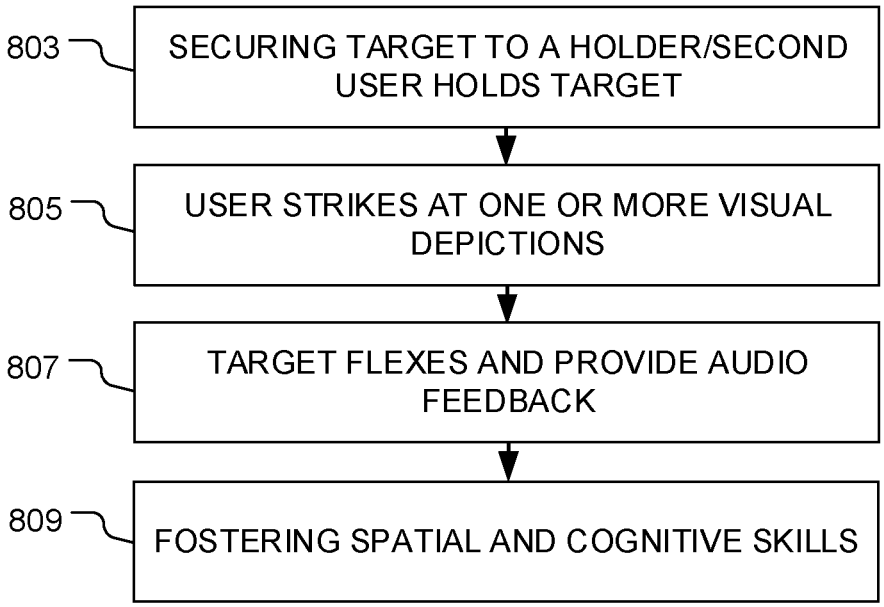
FIG. 8 is a flowchart of the method of use of the system of FIG. 7.

In FIG. 8, a flowchart 801 depicts a method of use of target 601 and system 701. During use, the target 601 is either held by a second user, or secured to a structure via one or more holding devices, as shown with box 803. The user can then strike at one or more of the visual depictions, wherein the body of the target flexes, and causes a popping/audio feedback, as shown with boxes 805, 807. The feedback provides for spatial and cognitive skill development, as shown with box 809.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An exercise system, comprising:

a target, comprising:

a rectangular body composed of a polycarbonate material, the polycarbonate material configured to allow the rectangular body to flex, such that a flex in the rectangular body causes an audible noise, and the polycarbonate material lacking padding;

the rectangular body extending from a top edge to a bottom edge and from a first side edge to a second side edge; and one or more handles each having an opening extending through a thickness of the rectangular body from a front surface to a back surface, the one or more handles positioned solely along the top edge of the rectangular body;

wherein striking the rectangular body causes the audible noise.

2. The exercise system of claim 1, wherein the target system further comprises:

one or more image depictions on the rectangular body.

3. The exercise system of claim 1, wherein the one or more handles each further comprises:

a rubber grip surrounding each of the openings to create a grip.

4. The exercise system of claim 1, wherein the rectangular body is an 18×22 inch rectangle.

5. The exercise system of claim 1, further comprising:

a holder configured to engage with a structure, the holder having:

a clamping device configured to engage with the structure; and a clip configured to engage with the one or more handles of the target;

wherein the holder is configured to hold the target while a user strikes the target.

* * * * *